US011792903B2

(12) United States Patent
Kahlman et al.

(10) Patent No.: US 11,792,903 B2
(45) Date of Patent: Oct. 17, 2023

(54) LED ARRANGEMENT AND METHOD OF CONTROLLING THE SAME

(71) Applicant: SIGNIFY HOLDING B.V., Eindhoven (NL)

(72) Inventors: Henricus Marius Joseph Maria Kahlman, Dongen (NL); Theo Gerrit Zijlman, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/770,380

(22) PCT Filed: Oct. 20, 2020

(86) PCT No.: PCT/EP2020/079414
§ 371 (c)(1),
(2) Date: Apr. 20, 2022

(87) PCT Pub. No.: WO2021/078697
PCT Pub. Date: Apr. 29, 2021

(65) Prior Publication Data

US 2022/0394834 A1 Dec. 8, 2022

(30) Foreign Application Priority Data

Oct. 22, 2019 (EP) ..... 19204518

(51) Int. Cl.
*H05B 45/59* (2022.01)
*H05B 45/52* (2020.01)

(52) U.S. Cl.
CPC ..... *H05B 45/59* (2022.01); *H05B 45/52* (2020.01)

(58) Field of Classification Search
None
See application file for complete search history.

(56) References Cited

U.S. PATENT DOCUMENTS

2019/0191520 A1 6/2019 DeJonge et al.
2020/0128635 A1* 4/2020 Wang ..... H05B 45/44

FOREIGN PATENT DOCUMENTS

EP 1608206 A1 12/2005
EP 2627157 A1 8/2013

* cited by examiner

*Primary Examiner* — Dedei K Hammond

(57) ABSTRACT

An LED arrangement having a LED string and a smoothing capacitor connected in parallel. A controllable voltage limiter is able to limit a voltage across the LED string to selectively prevent the LED string from outputting light. As the LED arrangement is turned ON, the controllable voltage limiter may activate so that the smoothing capacitor can be charged with a high current without activating the LED string.

14 Claims, 4 Drawing Sheets

LED ARRANGEMENT AND METHOD OF CONTROLLING THE SAME

CROSS-REFERENCE TO PRIOR APPLICATIONS

This application is the U.S. National Phase application under 35 U.S.C. § 371 of International Application No. PCT/EP2020/079414, filed on Oct. 20, 2020, which claims the benefit of European Patent Application No. 19204518.5, filed on Oct. 22, 2019. These applications are hereby incorporated by reference herein.

FIELD OF THE INVENTION

The present invention relates to the field of LED arrangements, and in particular, to controlling the operation of an LED arrangement during a startup procedure.

BACKGROUND OF THE INVENTION

Dimmable LED arrangements are being increasingly used in lamp applications, for example, as replacements for existing halogen bulbs. There is an ongoing desire to maximize the efficiency of such LED arrangements.

Typically, an LED arrangement comprises an LED string connectable to a rectified mains output or other voltage source, such as a battery or cell. A controllable current source can control the current drawn through the LED string in order to control a brightness level output by the LED string. The current may be controlled, for example, using a pulse width modulation (PWM) technique. In some applications, to improve power factor and efficiency of the LED arrangement, a smoothing capacitor is connected in parallel with the LED string in order to perform mains current shaping.

However, the inventors have recognized that a consequence of introducing this smoothing capacitor is an inherently slow response of the LED arrangement to a change in desired brightness intensity, such as during a startup procedure. In particular, such an LED arrangement is particularly slow to respond to a change from an OFF or "stand-by" state (i.e. no light output) to a low intensity light output (i.e. low brightness level).

There is therefore a desire to reduce the effect of the smoothing capacitor on the speed of changing a brightness level output by the LED string.

SUMMARY OF THE INVENTION

The invention is defined by the claims.

According to examples in accordance with an aspect of the invention, there is provided an LED arrangement for connecting to a voltage source. The LED arrangement comprises: an LED string comprising one or more LEDs and adapted to receive power from the voltage source; a controllable current source connected in series with the LED string; a capacitor connected in parallel with the LED string; a resistive load connected in parallel with the LED string; a controllable voltage limiter adapted to selectively limit a voltage across the LED string to be no greater than a first voltage level, wherein the first voltage level is lower than a forward voltage of the LED string; and a controller adapted to control the controllable current source and the controllable voltage limiter responsive to a indicative signal, indicating at least a change in a desired output brightness level of the LED string. The controller is adapted to: in response to the indicative signal indicating a desire to switch the brightness level of the LED string from a first brightness level to a second brightness level: during a first time period, control the controllable voltage source to limit the voltage across the LED string to be no greater than the first voltage level and control the controllable current source to adjust a charge stored by the capacitor; and after completion of the first time period, control the controllable voltage limiter to stop limiting the voltage across the LED string to be no greater than the first voltage level and control the controllable current source to attempt to draw current, from the voltage source, through the LED string so that a brightness of the LED string is at the second brightness level.

The present invention provides a way to appropriately and quickly charge or discharge the capacitor to have a suitable amount of charge for providing the second brightness level via the LED string, without activating the LED string to thereby avoid light flash, if turning the LED arrangement on, or gradual dimming ("fade"), if turning the LED arrangement off.

In a turn-ON scenario, i.e. during start-up, by setting the voltage across the LED string to be less than the forward voltage of the LED string, the charge of the capacitor can be rapidly adjusted (e.g. using an extremely large current) without driving the LED string using said large current. This can thereby increase the turn-ON speed and decrease the length of a turn-ON or startup procedure.

In a turn-OFF scenario, i.e. during switch-off, by setting the voltage across the LED string to be less than the forward voltage of the LED string, the LED string can be rapidly turned off (i.e. stop outputting light) by allowing any residual charge on the capacitor to discharge through the resistive load without passing through the LED string (as the voltage across the LED string is less than the forward voltage). This can thereby increase the turn-OFF speed and decrease the length of a turn-OFF or switch off procedure.

Embodiments thereby provide an LED arrangement that is more responsive to a desired change in brightness level, and in particular, to a desire to switch the LED arrangement between an ON-state and an OFF-state.

The controller may be adapted to, after the first time period, control the controllable current source to draw current using a pulse width modulation technique. This provides a simple and intuitive method of controlling the brightness level of light output by the LED string to achieve the second brightness level.

The controller may be adapted so that the average current drawn by the controllable current source during the first time period is greater than the average current drawn by the controllable current source after the first time period.

This ensures that the capacitor is more rapidly (dis) charged during the first time period than would be otherwise possible if the proposed method were not used (e.g. and the capacitor was charged using only the current required to achieve the second brightness level).

The first brightness level may be less than the second brightness level. The present invention is particularly advantageous when used to switch from a low brightness level to a higher brightness level, as rapid charging of the capacitor (to reach the charge required for the higher brightness level) can be attained.

In an embodiment, the first brightness level is zero and the second brightness level is non-zero. In other embodiments, the first brightness level is non-zero and the second brightness level is zero. Thus, in some embodiments, the first brightness level is zero and the second brightness level is non-zero or vice versa.

In some embodiments, the first brightness level is zero and the second brightness level is non-zero and no more than half or a quarter the maximum (possible) brightness level of the LED string. It has been described how slow charging of the capacitor is particularly prevalent when a small current is needed through the LED string (to achieve the second brightness level). Embodiments are therefore particularly advantageous when used to switch from an OFF-state to an ON-state with low dimming.

In some embodiments, the first time period may be skipped (e.g. the controllable voltage source may go unused) if the second brightness level is greater than a predetermined portion of the maximum possible brightness level of the LED string, e.g. greater than half or a quarter of the maximum possible brightness level.

The length of the first time period may be dependent upon the magnitude of the second brightness level. At low dimming levels, the required change in charge at the capacitor (e.g. to switch between the first and second brightness levels) is smaller than at high dimming levels. Thus, the length of the first time period may differ to take account of the required change in charge.

In some embodiments, the controllable voltage limiter comprises: a first impedance arrangement, formed of a series of one or more impedance elements, connected in parallel with the LED string; a second impedance arrangement connected between the first impedance arrangement and a ground or reference voltage, the first and second impedance arrangements being arranged to form a voltage divider between the voltage source and the ground or reference voltage; and a switching arrangement arranged to controllably bypass one or more of the impedance elements of the first impedance arrangement responsive to the controller, to thereby control an effective impedance of the first impedance arrangement and thereby a voltage across the LED string.

The switching arrangement may comprise a first transistor, having a base controlled by the controller and a collector and emitter connected between either side of at least one impedance element of the first impedance arrangement.

The first transistor is thereby able to selectively bypass the at least one impedance element of the first impedance arrangement through appropriate control of the base by the controller. Of course, the collector and/or emitter may be connected to a side of at least one impedance element of the first impedance arrangement by one or more further impedance elements (e.g. having a different combined resistance to the bypassed impedance elements of the first impedance arrangement).

In at least one embodiment, the first impedance arrangement comprises at least a first impedance element and a second, different impedance element; the collector and emitter of the first transistor of the switching arrangement are connected between a first and second side of the first impedance element respectively; and the switching arrangement further comprises a second transistor, having: a base connected to the second side of the first impedance element and a first side of the second impedance element; a collector connected to the first side of the first impedance element; and an emitter connected to a second side of the second impedance element.

The LED arrangement may further comprise a resistive load connected in parallel with the LED string.

According to examples in accordance with an aspect of the invention, there is provided a method of controlling an LED arrangement formed of an LED string, comprising one or more LEDs and adapted to receive power from a voltage source, a controllable current source connected in series with the LED string; and a capacitor connected in parallel with the LED string. The method comprises, in response to an indicative signal indicating a desire to switch the brightness level of the LED string from a first brightness level to a second, different brightness level: during a first time period: limiting the voltage across the LED string to a first voltage level and controlling a current drawn from the voltage source to thereby charge the capacitor; and after completion of the first time period, delimiting the voltage across the LED string and controlling a current drawn, from the voltage source, through the LED string so that a brightness of the LED string is at the second brightness level.

The average current drawn from the voltage source during the first time period may be greater than the average current drawn from the voltage source after the first time period. The first brightness level may be less than the second brightness level. The second brightness level may be no more than half the maximum brightness level of the LED string.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
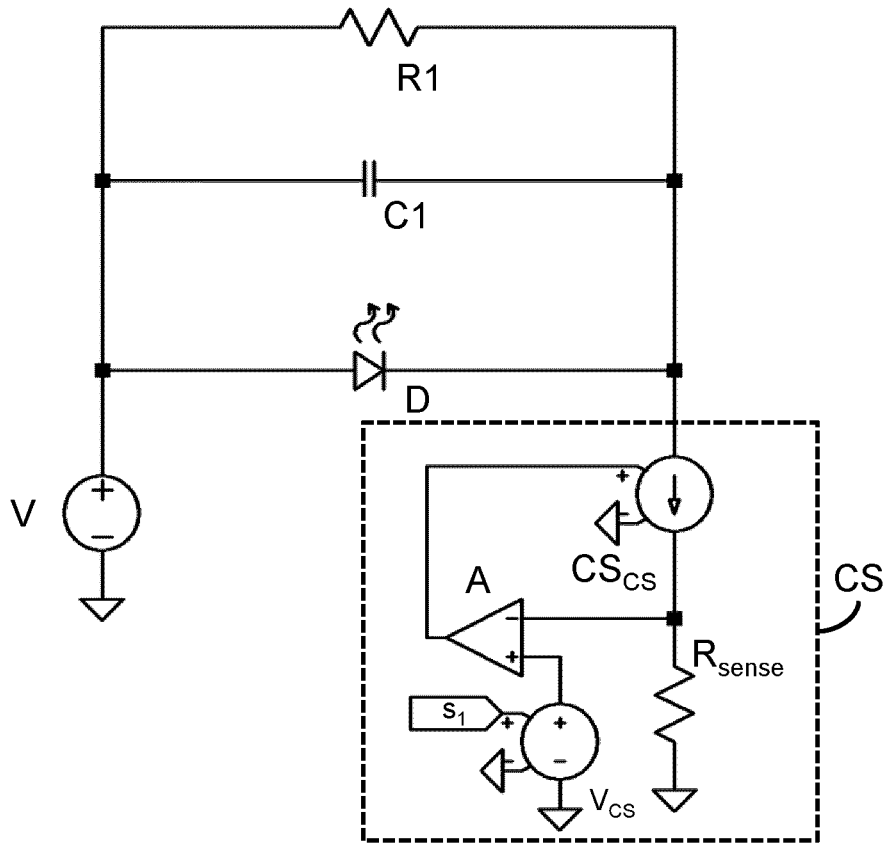
FIG. 1 illustrates an LED arrangement according to a known example.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

According to a concept of the invention, there is proposed an LED arrangement having a LED string and a smoothing capacitor connected in parallel. A controllable voltage limiter is able to limit a voltage across the LED string to selectively prevent the LED string from outputting light. As the LED arrangement is turned ON, the controllable voltage limiter may activate so that the smoothing capacitor can be charged with a high current without activating the LED string.

Embodiments are at least partly based on the realization that a smoothing capacitor in an LED arrangement can cause slow turn-ON and turn-OFF times for an LED arrangement. This is because the smoothing capacitor needs to store or remove an amount of charge before the LED string can activate or deactivate respectively. It has been recognized that restricting the voltage across the LED string, during a turn-ON or turn-OFF procedure or sequence, can prevent the LED string from being activated (i.e. output light) whilst the capacitor is appropriately charging/discharging. This enables a turn-ON or turn-OFF sequence to be performed more rapidly.

Illustrative embodiments may, for example, be employed in LED arrangements or LED systems, and is of particular use in lighting multi and single channel lamp drivers.

FIG. 1 illustrates an LED arrangement 100 according to known examples, which is provided for elucidating the advantages of the present invention.

The LED arrangement 100 comprises an LED string D and a capacitor C1 connected in parallel. The LED string D is adapted to draw power from a voltage source V. The LED arrangement further comprises a resistive load R1 connected in parallel with the LED string and capacitor C1.

A controllable current source CS is connected in series with the LED string D (and therefore the capacitor C1 and resistive load R1), and comprises a well-known configuration for a controllable current source. The controllable current source CS comprises a controllable voltage source $V_{CS}$, a current source $CS_{CS}$, a sensing resistor $R_{sense}$ and an operational amplifier A appropriately connected so that control of the controllable voltage source $V_{CS}$ controls the (average) current drawn by the controllable current source.

The function of the current source Cs is to deliver a fixed current to the LED independent of the voltage across the current source. In accordance with Ohm's law, the current through the LED ($I_{LED}$) is defined by:

$$I_{LED} = \frac{V_{CS}}{R_{sense}} \tag{1}$$

The operational amplifier A acts as a control element to maintain the voltage across the sensing resistor $R_{sense}$ at the control voltage $V_{CS}$, to thereby maintain the current.

In the illustrated example, the controllable current source is controllable or toggleable between two states, a first state in which it draws current and a second state in which it does not draw any current. Appropriate control of the state of the control current source, e.g. using a pulse width modulation technique, allows control over the average current drawn by the controllable current source.

The voltage source V may, for example, comprise a rectified mains supply or a battery source. The voltage source V may therefore be modelled as being a DC (direct current) power supply. The voltage source provides the power for driving the LED string.

The brightness level of light output by the LED string D is controlled by the controllable current source CS. In particular, the controllable current source CS can control an average current drawn through the LED string to thereby control the brightness level of light output by the LED string D.

The LED arrangement 100 is thereby switchable between at least an OFF or stand-by state (i.e. no desire for light to be output by the LED string D) and an ON state (i.e. a desire for light to be output by the LED string D). This can be performed by controlling the current drawn by the controllable current source S. In the OFF state, no current is drawn through the LED string. In the ON state, current is drawn through the LED string. When operating in the ON state, it is possible to control the magnitude of the current drawn by the controllable current source in order to control the brightness level of light output by the LED string D.

The (smoothing) capacitor C1 helps to smooth a current drawn through the LED arrangement, thereby improving power factor, efficiency and reducing light flicker. The resistive load R1 provides a current path (for discharging the capacitor C1) when the voltage across the LED string D falls below a forward voltage of the LED string D (e.g. if the LED arrangement is switched from an ON-state to an OFF-state).

Existing LED arrangements, such as LED arrangement 100, suffer from slow turn-ON times (i.e. switching from an OFF or stand-by state to an ON state or) due to the time required to charge the capacitor to an appropriate level. This is especially problematic when switching from an OFF/stand-by state to an ON state with a low brightness level. 1.

Consider a scenario in which the desired brightness level is switched from zero to a low lighting level. In this scenario, the (average) current drawn through the LED string to achieve the low lighting levels would result in the capacitor taking a relatively long time to appropriately charge, leading to a slow turn-ON time.

One method to overcome this problem could be to initially draw a large current through the LED arrangement in order to rapidly charge the capacitor. However, this would disadvantageously cause a "light flash", as the large current through the LED string would cause the LED string to output a bright light.

The present invention overcomes both these issues through use of a controllable voltage limiter to limit the voltage across the LED string to a level below the forward voltage (i.e. turn-ON voltage) of the LED string whilst rapidly charging the capacitor. This prevents the LED string from outputting a bright light whilst decreasing the time taken to charge the capacitor to an appropriate level.

Similarly, existing LED arrangements also suffer from slow turn-OFF times, as the capacitor will store an amount of charge that can continue to dissipate through the LED string (which thereby emits light) for a period of time after the controllable current source is switched off. This effect is sometimes called "fade".

The controllable voltage limiter of the present invention enables the voltage across the LED string to be rapidly limited to a voltage below the forward voltage level, thereby preventing the LED string from outputting light and rapidly switching the LED arrangement to an OFF state.

Figure 2:
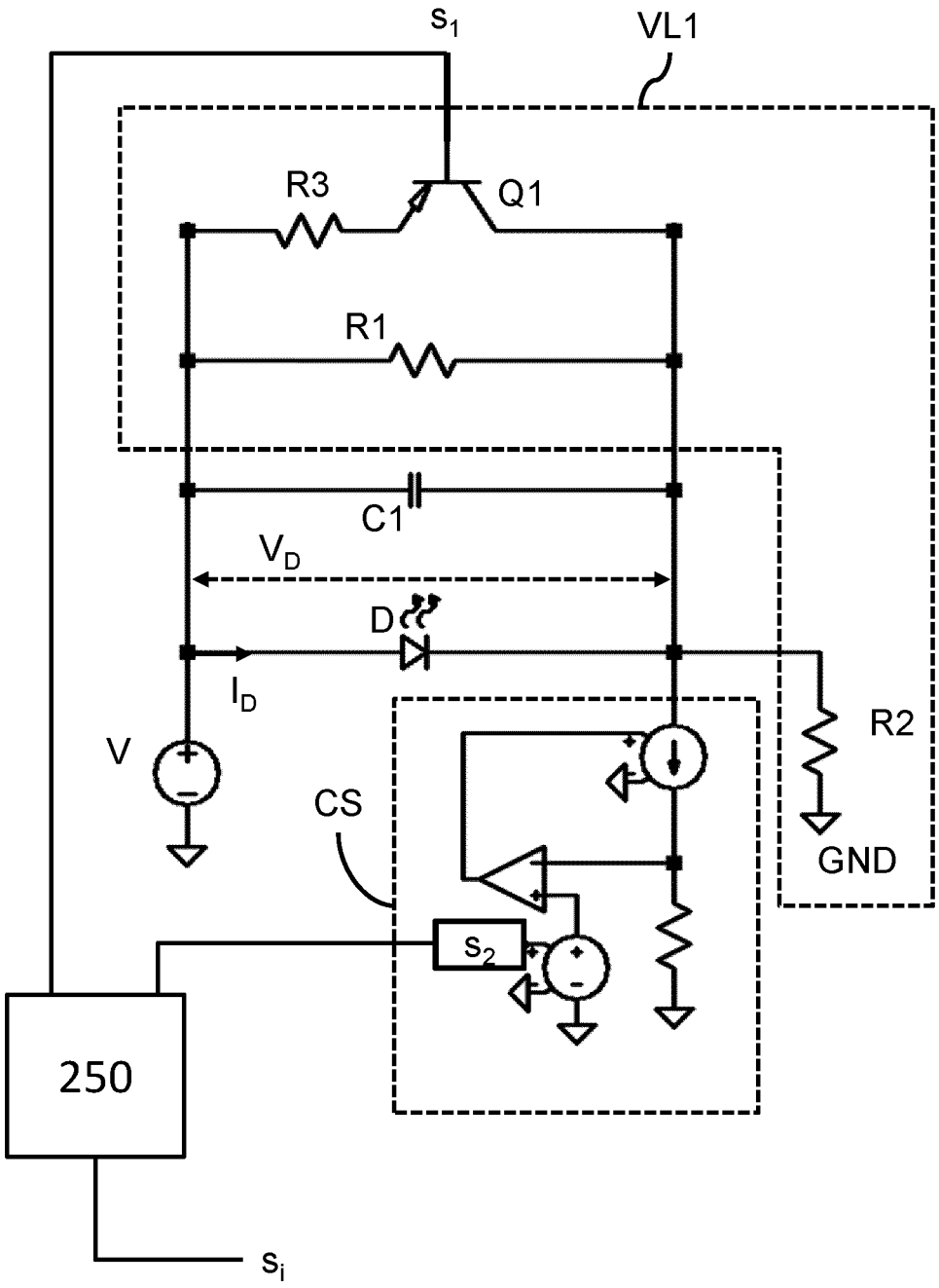
FIG. 2 illustrates an LED arrangement according to a first embodiment.

FIG. 2 illustrates an LED arrangement 200 according to an embodiment of the invention, which comprises an LED string D, a capacitor C1 and a controllable current source CS as previously described.

The LED arrangement 200 further comprises a controllable voltage limiter VL1. The controllable voltage limiter VL1 is configured to controllably limit (i.e. restrict and unrestrict) a voltage $V_D$ across the LED string D to a first predetermined voltage level. The first predetermined voltage level is less than a forward voltage of the LED string D. The forward voltage of an LED string would be well known to the skilled person and is sometimes labelled a "voltage drop".

In other words, the controllable voltage limiter is able to switch between a first mode in which it restricts the voltage $V_D$ across the LED string D to be no greater than a first predetermined voltage level and a second mode in which it does not restrict the voltage $V_D$ across the LED string D to be no greater than the first predetermined voltage level.

Thus, when operating in the second mode, the voltage $V_D$ across the LED string D is able to reach or exceed the forward voltage of the LED string.

The illustrated embodiment of the controllable voltage limiter VL1 of the LED arrangement 200 comprises a first impedance arrangement R1, a second impedance arrangement R2 and a switching arrangement Q1, R3.

The first impedance arrangement R1 is connected in parallel with the LED string D. The second impedance arrangement R2 is connected between the LED string (i.e. the first impedance arrangement) and a ground or reference voltage GND. The first and second impedance arrangement therefore effectively form a voltage divider.

The first impedance arrangement R1 also acts as a resistive load for providing a current path when the voltage across the LED string D falls below a forward voltage of the LED string D (e.g. if the LED arrangement is switched from an ON-state to an OFF-state).

The switching arrangement Q1, R3 comprises a switch, such as a transistor (e.g. MOSFET or BJT) adapted to controllably bypass the first impedance arrangement R1 to thereby control an effective impedance of the first impedance arrangement R1. In particular, the switching arrangement Q1 is configured to effectively switch an impedance between the first impedance arrangement R1 and the impedance R3.

The switching arrangement Q1, R3 can therefore effectively modify the voltage across the LED string D by switching between a first and second mode (i.e. opening or closing the switch Q1 respectively). In the first mode, the first impedance arrangement R1 and the second impedance arrangement R2 act as a voltage divider, fixing the voltage across the LED string to be no greater than particular voltage level. In a second configuration, the first impedance arrangement R1 and the impedance R3 are connected in parallel, modifying the fixed voltage level across the LED string D.

The impedance values for the components R1, R2 and R3 are appropriately selected (with due reference to the voltage level provided by the voltage source V) so that, when the switching arrangement is in the second mode and the LED arrangement is in a steady state, the voltage across the first impedance arrangement R1 and the LED string D is less than a forward voltage of the LED string.

The impedance values for the components R1, R2 are appropriately selected (with due reference to the voltage level provided by the voltage source V) so that, when the switching arrangement is in the first mode and the LED arrangement is in a steady state, the voltage $V_D$ across the LED string D is greater than or equal to the forward voltage of the LED string.

In this way, the controllable voltage limiter VL1 can be controlled to selectively fix (in steady state) a voltage level $V_D$ across the LED string D to a first predetermined voltage level, which is less than the forward voltage of the LED string.

The impedance R3 is optional and may be omitted in some embodiments. This would effectively result in the switching arrangement short-circuiting the LED string (i.e. effectively no voltage drop across the LED string, excluding any collector/emitter or source/drain voltage drop). In this scenario, the first predetermined voltage level is effectively zero (or equal to the voltage drop across the collector to the emitter or source to the drain of the switch Q1).

The LED arrangement 200 further comprises a controller 250. The controller 250 is adapted to control the controllable current source CS and the controllable voltage limiter VL1. This may be performed using a first $s_1$ and second $s_2$ control signal respectively.

The controller 250 is responsive to an indicative signal $s_1$, which indicates at least a desire to change an intensity of light output by the LED string D. This may be provided by a user interacting with a user interface (e.g. a dimmer or switch) or another device (such as a timer, scheduler or router).

The controller 250 is adapted to perform certain steps in response to the indicative signal indicating a desire to switch the brightness level of the LED string from a first brightness level to a second, different brightness level.

In response to the indication of the desired switch, the controller, during a first time period, controls the controllable voltage source to limit the voltage across the LED string to the first voltage level and controls the controllable current source to draw current through the controllable voltage limiter to thereby charge the capacitor.

After completion of the first time period (i.e. when the first time period ends), the controller 250 controls the controllable voltage limiter VL1 to delimit the voltage across the LED string D and control the controllable current source CS to draw current through the LED string D so that a brightness of the LED string is at the second brightness level.

By limiting the voltage across the LED string to the first voltage level, the voltage across the LED string is low enough to prevent the LED string from activating, thereby preventing flash, while allowing for fast charging (or discharging) of the capacitor.

Thus, in a turn-ON scenario, the capacitor is able to quickly charge during the first time period, thereby reducing the turn-ON time of the LED arrangement without causing LED flash due to a high current. Similarly, in a turn-OFF scenario, the capacitor is able to quickly discharge during the first time period and prevents the LED arrangement from outputting light whilst the capacitor discharges.

Preferably, during the first time-period, the controller controls the controllable current source to draw a maximum possible average current to thereby rapidly charge or discharge the capacitor.

In some embodiments, the controllable current source is designed to be controllable using a pulse width modulation technique. Correspondingly, the controller 250 may be adapted to control the controllable current source by providing a pulse width modulation signal that employs a pulse width modulation technique.

Thus, after completion of the first time period, the controller 250 may control the controllable current source using a pulse width modulation technique to control an average current through the LED string to achieve the second brightness level (e.g. providing a pulse width modulation signal with a duty cycle less than 100%, if a non-maximum amount of light is desired).

In a further embodiment, during the first time period, the controller 250 may provide the controllable current source with pulse width modulation signal having a duty cycle of 100%. This ensures the most rapid charging or discharging of the capacitor, thereby minimizing the length of the turn-ON or turn-OFF procedure.

As previously explained, the inventors have recognized that the present invention is particularly advantageous when there is a desire to switch the brightness level of the LED string from zero to a very low brightness level. Thus, in some embodiments, the second brightness level is no more than half the maximum brightness level of the LED string.

In some further embodiments, the second brightness level is no more than a quarter of the maximum brightness level of the LED string.

The maximum brightness level is the brightness level output by the LED string when the controllable current source is drawing current through the LED string at the maximum permissible average current (e.g. based on the components of the controllable current source or safety requirements, which may limit a maximum permissible average current).

The required length of the first time period may differ depending upon the desired brightness level output by the LED string D. In particular, the lower the brightness level, the less charge needs to be stored on the capacitor C in order to effectively operate, meaning that the length of the first time period may be reduced.

Thus, in some embodiments, the length of the first time period is dependent upon the magnitude of the second brightness level. In particular examples, the lower the magnitude of the second brightness level, the lower the length of the first time period.

Figure 3:
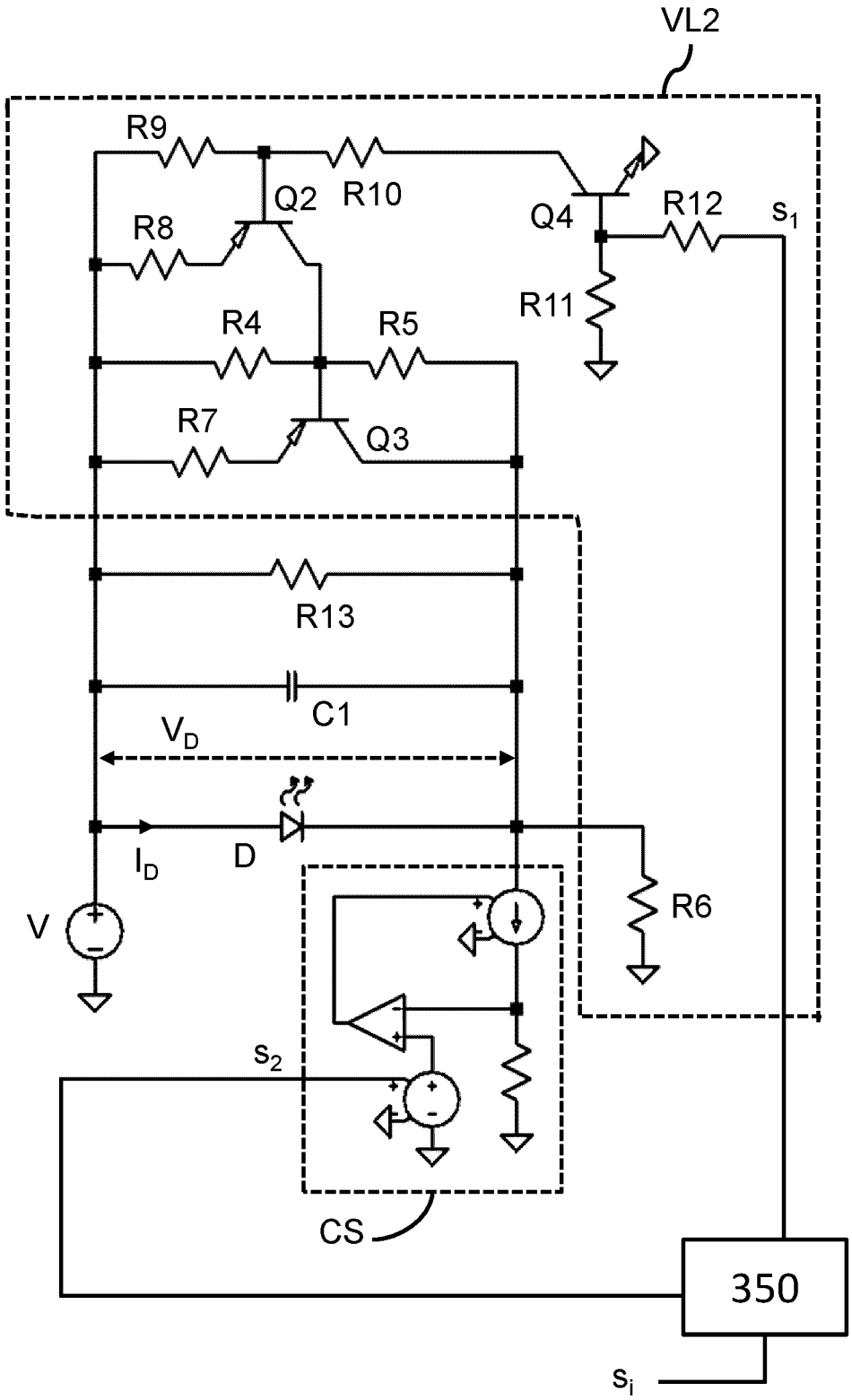
FIG. 3 illustrates an LED arrangement according to a second embodiment.

FIG. 3 illustrates an LED arrangement 300 according to a second embodiment of the invention. The LED arrangement 300 differs from the LED arrangement 200 by comprising a different controllable voltage limiter VL2.

The controllable voltage limiter VL2 of the LED arrangement 300 again comprises a first impedance arrangement R4, R5 and a second impedance arrangement R6. The controllable voltage limiter also comprises a switching arrangement Q2, Q3, Q4, R7, R8, R9, R10, R11, R12.

The first impedance arrangement is connected in parallel with the LED string D. The second impedance arrangement is connected between the LED string D and a ground or reference voltage.

The first impedance arrangement R4, R5 comprises a first impedance element R4 and a second, different impedance element R5. The second impedance arrangement R6 here comprises a single impedance element R6, but may comprise more than one impedance element in other embodiments.

The switching arrangement comprises a first PNP transistor Q2. The collector of the first PNP transistor Q2 is connected to a first side of the first impedance element R4 via a resistor R8 (which is optional). The emitter of the first PNP transistor Q2 is directly connected to a second side of the first impedance element. One or more additional resistors may be connected between the emitter/collector and the corresponding side of the first impedance element R4, in different embodiments.

The switching arrangement also comprises a second PNP transistor Q3. A base of the second PNP transistor is connected to the second side of the first impedance element R4 and a first side of the second impedance element R5 (i.e. between the first and second impedance elements). The collector of the second PNP transistor is connected to the first side of the first impedance element. The emitter of the second PNP transistor is connected to a second side of the second impedance element (i.e. the collector and emitter are connected between either side of the first impedance element). The base, collector and/or emitter may be connected via one or more additional resistances, such as a resistor R7, which resistances are optional.

The base of the first PNP transistor Q2 is controlled by a first control signal $s_1$, to thereby selectively control the voltage across the LED string D.

To facilitate appropriate control of the base of the first PNP transistor Q2, the switching arrangement comprises some additional (but optional) components, which act as a level shifter.

A collector of a first NPN transistor Q4 is connected to the base of the first PNP transistor Q2 (via optional resistor R10) and an emitter of the first NPN transistor Q4 is connected to a ground or reference voltage. A base of the first NPN transistor Q4 is controlled by the first control signal $s_1$ (here, via a voltage divider R12, R11 to appropriately bias a voltage at the base of the first NPN transistor). Further, the base of the first PNP transistor is connected to the voltage source V via a resistor R9 (which may be replaced by more than one resistor).

The first NPN transistor Q4 and resistors R11, R12 and R10 act as a level shifter. The first PNP transistor Q2 and resistors R8, R9 act as an enable/disable circuit (controlled by the first control signal). The second PNP transistor Q3 and resistors R4, R5 and R7 limit the voltage responsive to the enable/disable circuit.

The component values of the first impedance arrangement R4, R5 and additional resistance R7 define the LED limit voltage level.

The LED arrangement 300 comprises a controller 350 that controls the controllable voltage limiter VL2, using a first control signal $s_1$, and the controllable current source CS, using a second control signal $s_2$, in an analogous manner to the LED arrangement of the second embodiment (previously described). A further explanation of the operation of the controller will be explained later.

The LED arrangement 300 further comprises a resistive load R13, which can act as a current path. The resistive load R13 may be omitted in some embodiments, as its role may be taken by components of the controllable voltage limiter VL2 (e.g. resistors R4 and R5).

The resistive load R13 and the second impedance arrangement R6 can act to keep a pre-bias voltage across the capacitor C1.

Thus, in some embodiments, a resistive load may form part of the controllable voltage limiter VL2.

Figure 4:
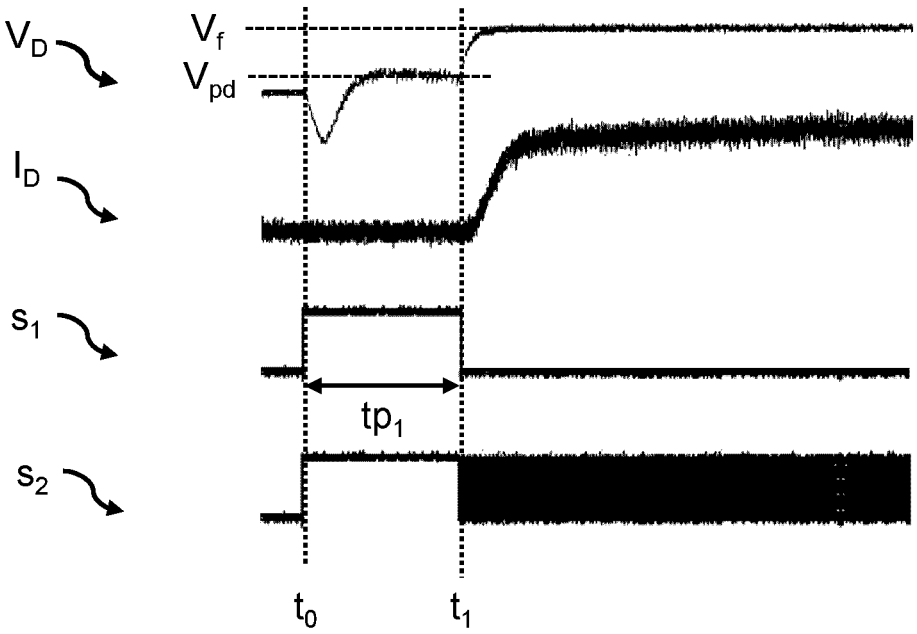
FIG. 4 illustrates waveforms for triggering an understanding of the second embodiment.

FIG. 4 illustrates waveforms for helping to explain the operation of the controller 350. The illustrated waveforms are provided over a period of time when the LED arrangement is switched from an OFF or stand-by state to an ON-state (with a low desired brightness level output by the LED string D), i.e. a "turn-ON" sequence.

FIG. 4 provides a first waveform $V_D$ representing the voltage across the LED string D, a second waveform $I_D$ representing the current through the LED string D, a third waveform $s_1$ representing the first control signal $s_1$ and a fourth waveform $s_2$ representing the second control signal $s_2$.

At a first point in time $t_1$, an indicative signal (not shown) indicates a desire to switch the LED arrangement from an OFF state to an ON state. This thereby indicates a desire to switch the brightness level output by the LED string D from a first brightness level (i.e. zero) to a second, greater brightness level (which is non-zero).

At this first point in time, the controller sets the first control signal $s_1$ so that the voltage $V_D$ across the LED string is held to be no greater than a predetermined voltage level $V_{pd}$. The predetermined voltage level $V_{pd}$ is set to be less than the forward voltage of the LED string, so that no current $I_D$ passes through the LED string.

At this first point in time $t_1$, the controller also sets the second control signal $s_2$ so that the controllable current source draws current. The second control signal $s_2$ is controlled so that the current drawn by the controllable current source is at a maximum (e.g. if controlled using PWM, a duty cycle of 100%).

A second point of time $t_2$ is defined as a time after a first time period $tp_1$, following the first point in time $t_1$ has expired.

At the second point of time $t_2$, the first control signal $s_1$ is set so that it no longer limits the voltage $V_D$ across the LED string, which thereby rises to a forward voltage of the LED string.

At the second point of time $t_2$, the second control signal $s_2$ is set to control an (average) current through the LED string to achieve the desired brightness level of light output by the LED string. As previously discussed, this may be performed by controlling the current using a pulse width modulation technique (as illustrated).

The described method thereby enables a maximum current to be drawn by the controllable current source during the first time period $tp_1$ to enable fast charging of the capacitor C1 to improve the "turn-ON" time of the LED arrangement.

With reference to FIGS. 2 and 3, the herein proposed LED arrangements 200, 300 may suffer from slow turn-OFF times (i.e. switching from an ON-state to an OFF-state). This may be due to the charge across the capacitor C1 taking an amount of time to dissipate (i.e. through the LED string D and second impedance arrangement R2, R6) when the controllable current source is controlled to draw no current (i.e. the LED arrangement is switched OFF).

There may therefore a "turn-OFF" sequence performed by the controller 250, 350 to reduce this impact.

In particular, the controller may be adapted to, in response to the indicative signal $s_1$ indicating a desire to switch the LED arrangement off (i.e. for the LED string to emit no output light), control the controllable voltage source VL1, VL2 to limit the voltage across the LED string D to the first voltage level and control the controllable current source to draw no current. This prevents the LED string D from outputting light (as the voltage across the LED string is less than the forward voltage), whilst allowing the capacitor C1 to discharge (e.g. through the resistive load R1, R13 and/or the controllable voltage limiter).

After a certain period of time has elapsed (e.g. a "second time period"), the charge stored on the capacitor will sufficiently fall to an amount where no or negligible current can flow across the LED. Thus, after a second time period has elapsed, there is no need to control the controllable voltage source to limit the voltage across the LED string. here is no need to control the controllable voltage limiter to stop limiting the voltage across the LED string (except to minimize any power loss caused by operating the controllable voltage limiter).

The length of the second time period may be fixed, dynamic (e.g. based upon the brightness level or current preceding the second time period) or indefinite (e.g. until the first time period is triggered again). The length of the second time period is preferably selected so that the capacitor C1 has sufficient time to discharge to a level that, if the controllable voltage limiter stopped limiting the voltage, the voltage across the LED string would be less than the forward voltage of the LED string. The skilled person would be capable of appropriately selecting or defining a length of the second time period.

In any above described embodiment, rather than being connectable to a DC voltage source, the LED arrangement may be adapted to connected to an AC (alternating current) voltage source, e.g. by itself comprising a rectifier. Such modifications would be known to the skilled person.

In any above described embodiment, reference to a "capacitor" refers to any impedance arrangement having an intentional (i.e. not parasitic) element of capacitance, such as an array of capacitors, a single capacitor and so on.

In one embodiment, there is provided an LED system comprising any herein described embodiment of the LED arrangement and a user interface for defining the indicative signal $s_i$. The indicative signal indicates a desired level of brightness of light output by the LED string, such that the user interface acts as a dimmer. In particular, the indicative signal may be responsive to a user input provided at the user interface.

Other methods of defining the indicative signal will be apparent to the skilled person, e.g. using a further controller responsive to one or more of: a schedule, an ambient light level, movement, wireless signals, infrared signals and so on. There may be provided an LED system comprising any described LED arrangement and such a further controller.

Figure 5:
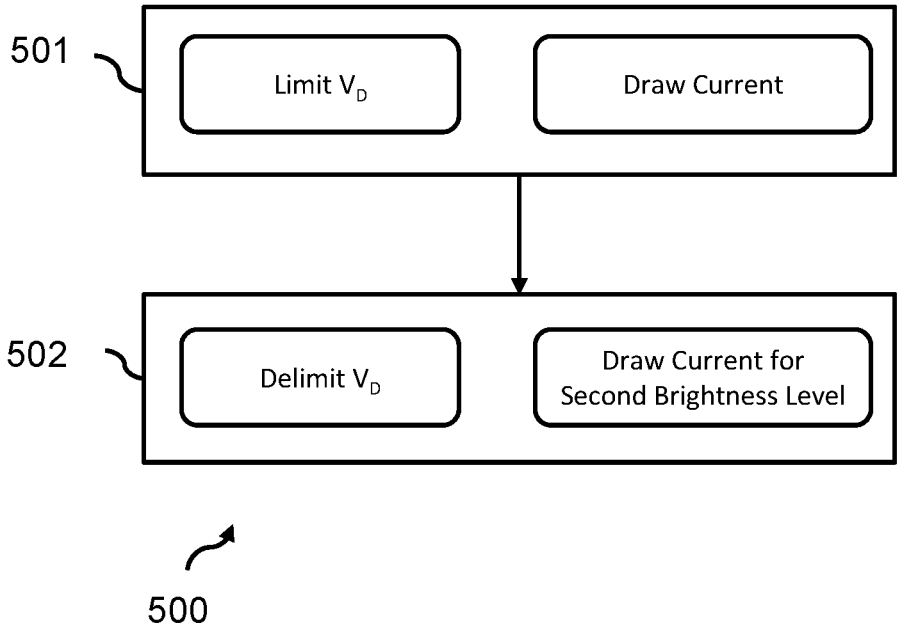
FIG. 5 illustrates a method according to an embodiment.

FIG. 5 illustrates a method 500 of controlling an LED arrangement.

The method is for use with an LED arrangement formed of an LED string, comprising one or more LEDs and adapted to receive power from a voltage source, a controllable current source connected in series with the LED string; and a capacitor connected in parallel with the LED string.

The method 500 is performed in response to an indicative signal indicating a desire to switch the brightness level of the LED string from a first brightness level to a second, different brightness level.

The method comprises a first step 501 which is performed during a first or initial time period. The first step 501 comprises limiting the voltage across the LED string to a first voltage level and controlling a current drawn from the voltage source to thereby charge the capacitor. The first step is performed for the entirety of the first/initial time period.

After completion of the first time period, a second step 502 is performed, which comprises delimiting the voltage across the LED string and controlling a current drawn, from the voltage source, through the LED string so that a brightness of the LED string is at the second brightness level.

The method may be appropriately adapted to carry out any function of the controller previously described.

Where reference is made to a transistor, MOSFETs and BJTs are considered to be suitable options, with the relevant terminology being used where appropriate. Thus, the term "base" is interchangeable with the term "gate", the term "collector" is interchangeable with the term "source" and the term "emitter" is interchangeable with the term "drain".

The skilled person would be readily capable of developing a controller for carrying out any herein described method. Thus, each step of the flow chart may represent a different action performed by a controller and may be performed by a respective module of the processing system. Similarly, the skilled person would be readily capable of developing a method for performing the functions of any herein described controller.

Embodiments make use of a controller. The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable, such that the one or more programs stored thereon can be loaded into a processor or controller.

It will be understood that disclosed methods are preferably computer-implemented methods. As such, there is also proposed the concept of computer program comprising code means for implementing any described method when said program is run on a processing system or controller.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. If a computer program is discussed above, it may be stored/distributed on a suitable medium, such as an optical storage medium or a solid-state medium supplied together with or as part of other hardware, but may also be distributed in other forms, such as via the Internet or other wired or wireless telecommunication systems. If the term "adapted to" is used in the claims or description, it is noted the term "adapted to" is intended to be equivalent to the term "configured to". Any reference signs in the claims should not be construed as limiting the scope.

The invention claimed is:

1. An LED arrangement for connecting to a voltage source, the LED arrangement comprising:

an LED string comprising one or more LEDs and adapted to receive power from the voltage source;

a controllable current source connected in series with the LED string;

a capacitor connected in parallel with the LED string;

a controllable voltage limiter adapted to selectively limit a voltage across the LED string to be no greater than a first voltage level, wherein the first voltage level is lower than a forward voltage of the LED string; and a controller adapted to control the controllable current source and the controllable voltage limiter responsive to an indicative signal, indicating at least a change in a desired output brightness level of the LED string, wherein the controller is adapted to:

in response to the indicative signal indicating a desire to switch the brightness level of the LED string from a first brightness level to a second brightness level:

during a first time period, control the controllable current source to limit the voltage across the LED string to be no greater than the first voltage level and control the controllable current source to adjust a charge stored by the capacitor; and after completion of the first time period, control the controllable voltage limiter to stop limiting the voltage across the LED string to be no greater than the first voltage level and control the controllable current source to draw current, from the voltage source, through the LED string so that a brightness of the LED string is at the second brightness level, wherein the controllable voltage limiter comprises:

a first impedance arrangement, formed of a series of one or more impedance elements, connected in parallel with the LED string;

a second impedance arrangement connected between the first impedance arrangement and a ground or reference voltage, the first and second impedance arrangements being arranged to form a voltage divider between the voltage source and the ground or reference voltage; and a switching arrangement arranged to controllably bypass one or more of the impedance elements of the first impedance arrangement responsive to the controller, to thereby control an effective impedance of the first impedance arrangement and thereby a voltage across the LED string.

2. The LED arrangement of claim 1, wherein the controller is adapted to, after the first time period, control the controllable current source to draw current using a pulse width modulation technique.

3. The LED arrangement of claim 1, wherein the controller is adapted so that the average current drawn by the controllable current source during the first time period is greater than the average current drawn by the controllable current source after the first time period.

4. The LED arrangement of claim 1, wherein the first brightness level is less than the second brightness level.

5. The LED arrangement of claim 4, wherein the first brightness level is zero and the second brightness level is non-zero.

6. The LED arrangement of claim 4, wherein the second brightness level is no more than half the maximum brightness level of the LED string.

7. The LED arrangement of claim 1, wherein the length of the first time period is dependent upon the magnitude of the second brightness level.

8. The LED arrangement of claim 1, wherein the switching arrangement comprises a first transistor, having a base controlled by the controller and a collector and emitter connected between either side of at least one impedance element of the first impedance arrangement.

9. The LED arrangement of claim 8, wherein:

the first impedance arrangement comprises at least a first impedance element and a second, different impedance element;

the collector and emitter of the first transistor of the switching arrangement are connected between a first and second side of the first impedance element respectively; and the switching arrangement further comprises a second transistor, having:

a base connected to the second side of the first impedance element and a first side of the second impedance element;

a collector connected to the first side of the first impedance element; and an emitter connected to a second side of the second impedance element.

10. The LED arrangement of claim 1, further comprising a resistive load connected in parallel with the LED string.

11. A method of controlling an LED arrangement formed of an LED string, comprising one or more LEDs and adapted to receive power from a voltage source, a controllable current source connected in series with the LED string, a capacitor connected in parallel with the LED string, and a controllable voltage limiter adapted to selectively limit a voltage across the LED string to be no greater than a first voltage level, wherein the first voltage level is lower than a forward voltage of the LED string; the method comprising, in response to an indicative signal indicating a desire to switch the brightness level of the LED string from a first brightness level to a second, different brightness level:

during a first time period: controlling the controllable current source to limit the voltage across the LED string to be no greater than the voltage level and control the controllable current source to adjust a charge stored by the capacitor; and after completion of the first time period, controlling the controllable voltage limiter to stop limiting the voltage across the LED string to be no greater than the first voltage level and control the controllable current source to draw current, from the voltage source, through the LED string so that a brightness of the LED string is at the second brightness level, wherein the controllable voltage limiter comprises:

a first impedance arrangement, formed of a series of one or more impedance elements, connected in parallel with the LED string;

a second impedance arrangement connected between the first impedance arrangement and a ground or reference voltage, the first and second impedance arrangements being arranged to form a voltage divider between the voltage source and the ground or reference voltage; and a switching arrangement arranged to controllably bypass one or more of the impedance elements of the first impedance arrangement, to thereby control an effective impedance of the first impedance arrangement and thereby a voltage across the LED string.

12. The method of claim 11, wherein the average current drawn from the voltage source during the first time period is greater than the average current drawn from the voltage source after the first time period.

13. The method of claim 11, wherein the first brightness level is less than the second brightness level.

14. The method of claim 13, wherein the second brightness level is no more than half the maximum brightness level of the LED string.

* * * * *